United States Patent [19]

Vouzellaud

[11] Patent Number: 4,849,084

[45] Date of Patent: Jul. 18, 1989

[54] TUBULAR ROD FOR THE TREATMENT OF THE INSIDE SURFACE OF A TUBE

[75] Inventor: Alain Vouzellaud, Villeurbanne, France

[73] Assignee: Framatome, Courbevoie, France

[21] Appl. No.: 193,686

[22] Filed: May 13, 1988

[30] Foreign Application Priority Data

May 14, 1987 [FR] France ..... 87 06792

[51] Int. Cl.[4] ..... C17D 17/00

[52] U.S. Cl. ..... 204/224 R; 204/272; 204/275; 204/277; 204/279

[58] Field of Search ..... 204/206, 224 R, 224 M, 204/225, 272, 277, 279, 26; 134/167 C, 168 C; 138/89, 97, 98, 93; 118/408

[56] References Cited

U.S. PATENT DOCUMENTS

| | | | |
|---|---|---|---|
| 2,859,157 | 11/1958 | Curtiss, Jr. | 204/224 R X |
| 2,970,950 | 2/1961 | Bahmann | 204/26 |
| 3,429,787 | 2/1969 | Weinreich | 204/26 |
| 3,618,639 | 11/1971 | Daley et al. | 138/97 |
| 3,673,073 | 6/1972 | Tobey et al. | 204/26 |
| 3,974,042 | 8/1976 | Angelini | 204/224 R X |
| 4,369,101 | 1/1983 | Wolff et al. | 204/272 X |
| 4,393,805 | 7/1983 | Boer | 138/97 X |
| 4,529,008 | 7/1985 | Appleton | 138/97 |
| 4,624,750 | 11/1986 | Malagola et al. | 204/26 |

*Primary Examiner*—Donald R. Valentine

*Attorney, Agent, or Firm*—Pollock, Vande Sande & Priddy

[57] ABSTRACT

The rod incorporates a sealing device enabling a part of the inside surface of the tube, extending along its length, to be isolated from adjacent zones. The sealing device comprises two assemblies (5, 6) spaced along the length of the rod and each consisting of an annular piston (26, 36) slidably mounted on the body (2) of the rod, and at least one annular seal (32, 42) interposed between the piston and a radial support flange (33, 43). Compressed air supplied to the piston (26, 36) enables the seal (32, 42) to be compressed and to undergo radial expansion.

8 Claims, 6 Drawing Sheets

TUBULAR ROD FOR THE TREATMENT OF THE INSIDE SURFACE OF A TUBE

FIELD OF THE INVENTION

The invention relates to a tubular rod for the treatment of the inside surface of a tube with a liquid supplied through the rod, which incorporates a sealing device disposed around the tubular body of the rod.

Rods of tubular shape are known which make it possible to establish a circulation of treatment liquid in contact with a zone of a tube to be treated, and optionally to supply an electric current for the purpose of electrolysis of the liquid in that zone.

BACKGROUND OF THE INVENTION

In particular, a rod of this kind may be used for effecting metal coating, such as nickel-plating, inside a tube.

In the case of tubes of great length and small diameter, for example in the case of a steam generator tube in a pressurized water nuclear reactor, whose inside diameter is close to 0.02 meter and which comprises two straight portions whose length is greater than ten meters, it may be necessary to effect metal coating, such as nickel-plating, in certain zones of the tube in order to improve its resistance to corrosion during operation.

A treatment of this kind is very often applied to a zone of the tube situated at the outlet face of the tube plate, i.e. a short distance from one of the inlets of the tube, this distance being less than one meter.

It may however be desirable to treat the inner surface of the tube in one of its straight portions at any distance from the inlets of this tube which are flush with the inlet face of the tube plate.

Rods for the treatment of the inside surface of steam generator tubes must be provided with sealing devices enabling the part of the tube to which the treatment is applied to be isolated from adjacent zones, in order to avoid leakages of electrolyte on each side of the zone treated.

Treatment rods of this kind which incorporate sealing devices have been used fairly commonly for the treatment of zones of the tube which are situated inside or near the tube plate. The rod effecting the treatment is supported and centered in the tube being treated by means of its base, which comprises a plurality of centering elements adapted to be introduced into tubes adjoining the tube to be treated. The base member of the rod also incorporates means for effecting the distribution of fluid in the rod, particularly the fluid used for the treatment. A treatment rod of this kind and the sealing device associated with it are of complex structure and consist of numerous parts, so that it is difficult to ensure their correct operation, and leakages of electrolyte liquid may occur at the ends of the zone to be treated.

In addition, a device is known which enables any zone of one of the rectilinear portions of the tube to be treated, and which incorporates a set of braces which must be installed in the tube in proportion as the rod is introduced into the latter. This rod incorporates sealing means consisting of inflatable seals the utilization of which is complex.

SUMMARY OF THE INVENTION

The invention therefore proposes a tubular rod for the treatment of the inside surface of a tube with a liquid supplied through the rod, which incorporates a sealing device disposed around the tubular body of the rod and makes it possible to isolate a part of the inside surface of the tube, extending along its length, from adjacent zones of the tube, said tubular rod having a simple structure and enabling very good sealing in respect of the liquid to be achieved on each side of the zone to be treated.

To this end, the sealing device comprises two assemblies spaced apart over the length of the rod and each consisting of a piston of annular shape mounted for movement in the axial direction around the body of the rod, at least one flexible annular seal disposed around the body of the rod and interposed, in the axial direction, between one end of the piston and a radial support flange, and means for the remote operation of the piston for its axial displacement in one direction or the other.

BRIEF DESCRIPTION OF THE DRAWINGS

In order to enable the invention to be clearly understood, a description will now be given, by way of example and with reference to the accompanying drawings, of several embodiments of a rod according to the invention, which is used for the internal nickelling of a steam generator tube.

DESCRIPTION OF THE PREFERRED EMBODIMENTS

Figure 1:
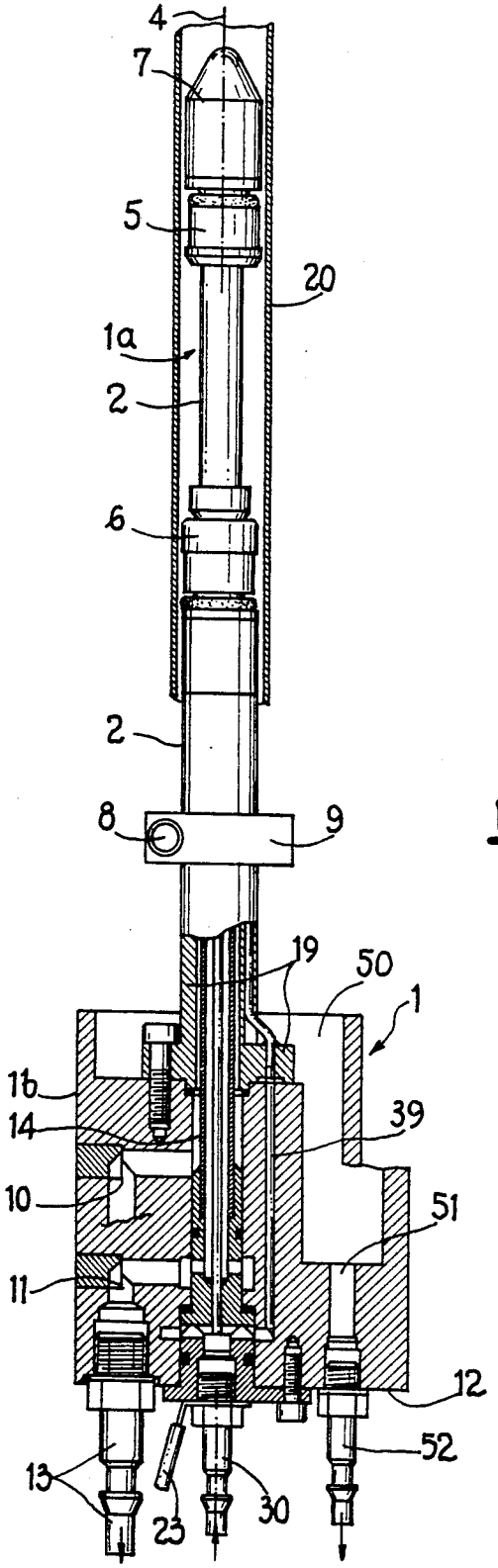
FIG. 1 is a view in elevation, partly in section, of the nickelling rod.
Figure 2A:
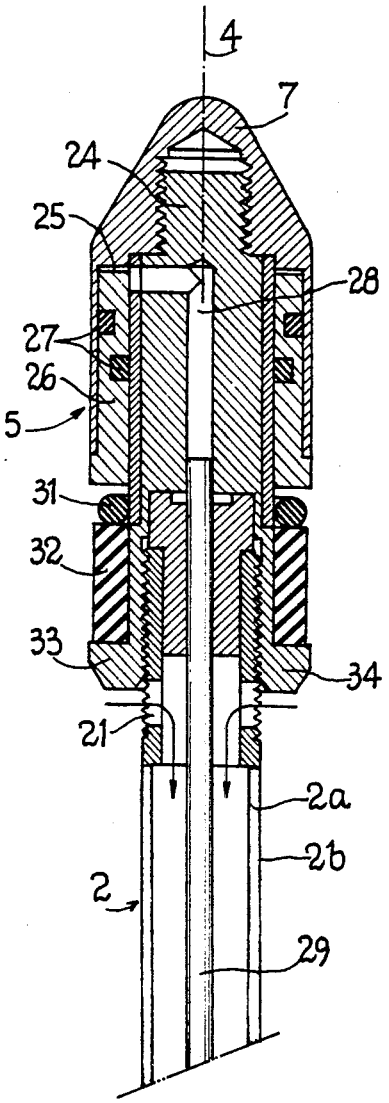
FIGS. 2*a* and 2*b* are sectional views of the nickelling rod shown in FIG. 1, taken at each of the sealing assemblies of said rod.
Figure 2B:
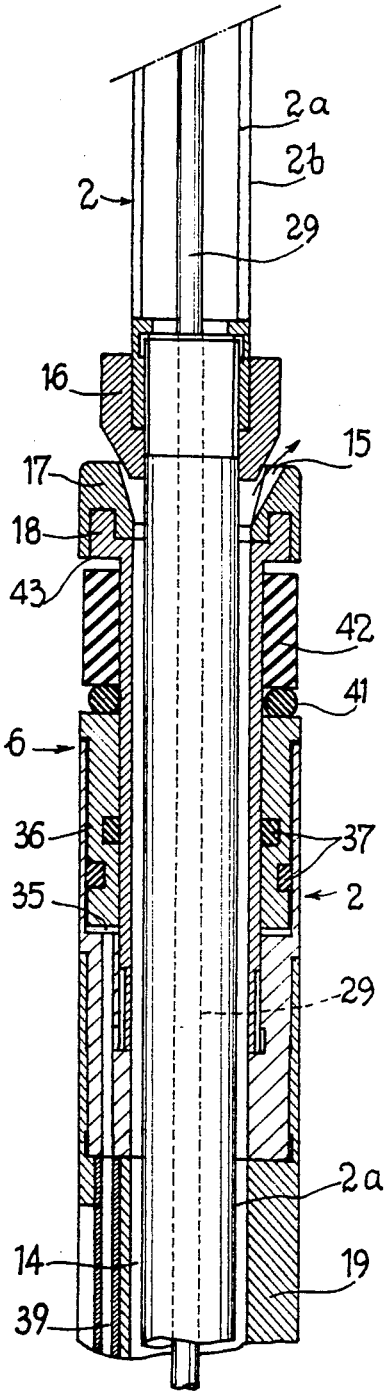

In FIGS. 1, 2*a* and 2*b* show a first embodiment of a nickelling rod 1 which makes it possible to form a coating inside a tube. This nickelling rod 1 is of entirely rigid construction and comprises the actual rod 1*a*, which is introduced into the tube, and a distributor block 1*b* permitting the distribution of fluid in the rod and rigidly connected to one end of the actual rod 1*a*.

The part 1*a* comprises a body 2 of tubular shape, composed of an assembly of casings and parts of tubular shape, such as 2*a* and 2*b*. The sealing device of the rod comprises two sealing assemblies 5 and 6 disposed around the body 2 and spaced apart in the axial direction 4 of the rod 1*a*. The body 2 is provided at its end with a head 7 of profiled shape. The rod 1*a* is also provided, above the distribution block 1*b*, with a ring 9 mounted for sliding on the outer surface of the body 2 of the rod and adapted to be locked in respect to axial position by means of a screw 8. The ring 9 comes to bear against the inlet face of the tube plate with which the inlet end of the tube to be treated lies flush, and enables the length of the rod 1*a* introduced into the tube to be adjusted. This adjustment makes it possible to situate the active zone of the nickelling rod, lying between the sealing assemblies 5 and 6, so as to coincide with the zone of the tube which is to be treated.

The distribution block 1*b* is machined internally to form a duct 10 supplying the rod with electrolyte liquid, and a duct 11 for the recovery of the electrolyte which has circulated in the rod. The ducts 10 and 11 lead out onto the end face 12 of the block 1*b* at the sites of connections, such as 13, enabling them to be connected to a flexible tube.

The duct 10 communicates inside the block 1*b* with the outer annular duct 14 of the tubular body 2. The annular duct 14 leads out of the body 2 by way of an annular opening 15 situated just above the sealing assembly 6 and bounded by two members 16 and 17 having frusto-conical surfaces. The member 16 is fastened to the tubular casing 2*b* of the body 2, and the member 17 is fastened to a sleeve 18 forming the outer wall of the annular passage 14 and connected at the bottom to a very thick sleeve 19, which in turn is fixed to the distributor block 1*b* at the bottom. The assembly of casings and tubular parts 2*a*, 2*b*, 18 and 19 constitutes the tubular body 2. At the top, below the sealing assembly 5, the casings 2*a* and 2*b* are provided with through holes 21 bringing the interior of the tube 2*a* into communication with the space existing between the active part of the rod 1*a* lying between the sealing assemblies 5 and 6 and the inside surface of the tube 20 on which the coating is to be formed.

The electrolyte liquid delivered into the annular passage 14 by way of the supply duct 10 flows out of the body 2 of the rod via the annular opening 15. The liquid comes into contact with the inside surface of the tube over the entire length of the zone to be treated, and is then recovered inside the tube 2*a* by way of the openings 21. The electrolyte liquid then returns via the central duct formed by the tubular casing 2*a* to the inlet of the duct 11. The tubular casing 2*b* of the body 2 of the rod constituting the electrode is brought to a certain potential in relation to the tube 20 with the aid of an electrical connector 23 connected to the base of the distributor block 1*b*. The electrolysis of the liquid flowing along the inside wall of the tube 20 is thus effected in the treatment zone, making it possible to deposit a layer of coating nickel on the inside surface of the tube.

The sealing assemblies 5 and 6 of the nickelling rod 1, which will be described below, make it possible to achieve perfect confinement of the electrolyte liquid and to prevent any leakage on either side of the zone of the tube being treated.

As can be seen in FIG. 2*a*, the body 2 of the rod carries at the top an end member 24, on which the head 7 is fixed. The member 24 and the head 7 delimit between them an annular chamber 25, in which a piston 26 of annular shape is mounted for movement in the direction of the axis 4 of the rod.

The piston 26 is mounted sealingly in the annular chamber 25 with the aid of ring seals 27. The annular chamber 25 is in communication with a duct 28 machined inside the end member 24 and in turn in communication with a tube 29 extended along the axis 4 of the rod and connected at the bottom, at the distribution block 1*b*, to a nozzle 30 enabling it to be connected by means of a flexible hose to a compressed air supply means.

When compressed air is admitted into the chamber 25, the piston 26 is pushed back downwards in the axial direction and comes to bear, by way of a ring 31 of plastic material, against a flexible annular rubber seal 32 bearing, at its end opposite to that facing the ring 31 and the piston 26, against a shoulder 33 machined on a member 34 fastened to the body 2 of the rod. The bottom part of the member 34 thus constitutes a flange which projects radially and against which the flexible annular seal 32 comes to bear. When the piston 26 is operated by the compressed air, the seal 32 undergoes compression and radial expansion, so as to come into sealing contact with the inside surface of the tube 20.

FIG. 2*b* shows that the sleeves 18 and 19 delimit between them an annular chamber 35 whose axis is the axis 4 of the rod and which encloses a piston 36 mounted sealingly and movably in the chamber 35 with the aid of the ring seals 37. The chamber 35 is supplied with compressed air by means of a duct 39 connected to a chamber which is formed in the distribution block 1*b* and into which the nozzle 30 leads.

The pistons 26 and 36 can therefore be operated simultaneously when compressed air is supplied to the nozzle 30. The piston 36 then comes to bear, by way of a ring 41 of plastic material against a flexible annular rubber seal 42 mounted on the outer surface of the sleeve 18. The sleeve 18 is provided with a top shoulder 43 constituting a radial support flange for the end of the annular seal 42 opposite to that facing the ring 41 and the piston 36. The displacement of the piston 36 in the upward direction through the action of the compressed air results in the compression and radial expansion of the seal 42, which then comes into sealing contact with the inside surface of the tube 20.

After the nickelling rod 1 has been placed in position in the tube, the supply of compressed air from the nozzle 30 enables the zone of the tube 20 in which the nickelling is effected as described above to be perfectly isolated.

Figure 3:
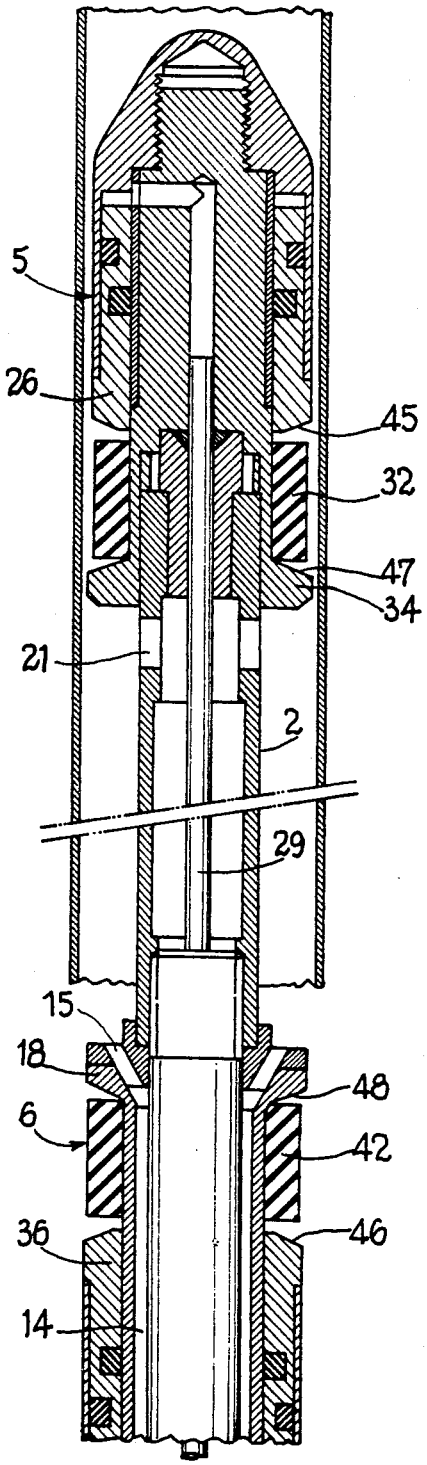
FIG. 3 is a second embodiment of the sectional view of a nickelling rod shown in FIGS. 1, 2*a* and 2*b*.

FIG. 3 shows a modified form of the sealing devices 5 and 6, the corresponding components in FIGS. 2*a* and 2*b* on the one hand and in FIG. 3, on the other hand, being given the same reference numerals.

In this modified embodiment, the end surfaces 45 and and 46 of the pistons 26 and 36, respectively, and the support surfaces 47 and 48 of the member 34 and the sleeve 18, respectively, have been bevelled, the bevel surfaces facing one another in pairs being inclined in different directions. The pistons 26 and 36 come into contact with the elastic seals 32 and 42, respectively, without the interposition of a ring of plastic material. When compression is applied, the annular pistons 26 and 36, whose ends are bevelled, compress the elastic seals 32 and 42, which are retained by the bevelled shoulders 47 and 48. This results in compression of the elastic seals, which promotes radial expansion of the central portion of these elastic seals which come into contact with the tube 20.

In the modified embodiment shown in FIG. 3, the apertures 15 and 21 for the passage of the electrolyte fluid also differ slightly from the embodiment illustrated in FIGS. 2*a* and 2*b*. However, the circulation of the electrolyte fluid from the duct 14 and its return through the central part of the tubular body 2, around the air duct 29, is identical to that described with reference to FIGS. 2*a* and 2*b*.

At the end of a nickelling operation, the supply of electroytic liquid to the rod is interrupted and the electrolytic liquid is recovered through the duct 11 and the nozzle 13. If any debris or waste material remains in the tube at the end of the nickelling operation, this will be recovered with the aid of a top cylindrical cavity 50 and a duct 51 which are machined in the distribution block 1*b*, the duct 51 being in communication with a nozzle 52 for the discharge of debris or waste material.

Figure 4:
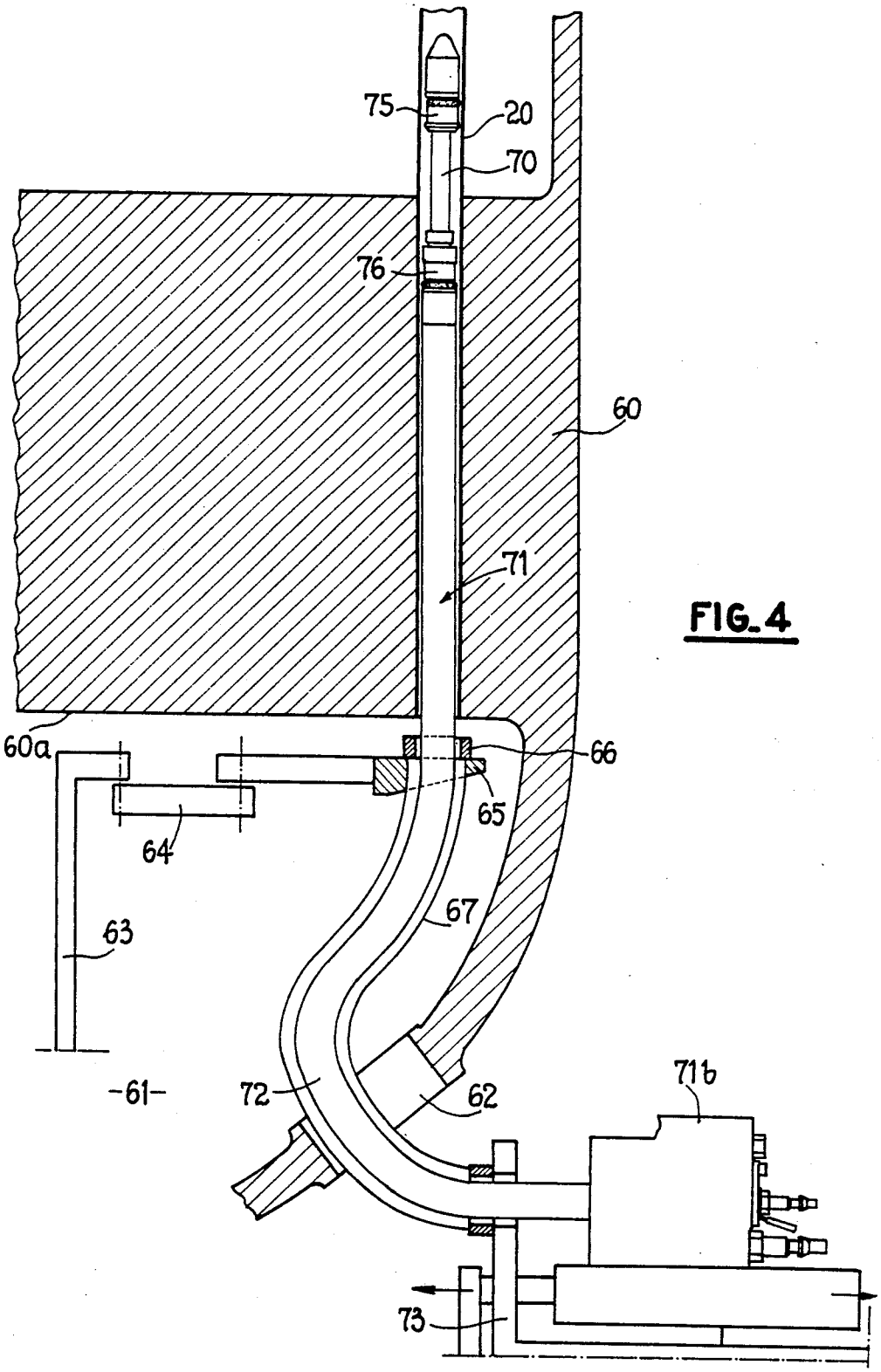
FIG. 4 is a view in elevation of a nickelling rod having a flexible portion, in the working position in a steam generator tube.

FIG. 4 shows a nickelling rod 1 in position for operation inside a tube 20 fastened in the tube plate 60 of a steam generator of a pressurized water nuclear reactor. Under the inlet face 60*a* of the tube plate 60, with which the end of the tube 20 lies flush, the steam generator is provided with a water container 61, in which an inspection opening or manhole 62 is disposed.

Inside the water container 61 is mounted a carrier device 63 comprising an arm 64, at the end of which is fixed a carrier 65, to which is connected an end ring 66 of a flexible guide hose 67. The device 63, of conventional type, allows the carrier to be displaced to bring it in succession into coincidence with the inlet end of each of the tubes to be treated.

The nickelling rod 1 has a rigid end portion 70, which can be constructed like the part of the rigid rod described previously and illustrated in FIGS. 2*a*, 2*b* and 3. This rigid part is provided with two sealing assemblies 75 and 76, whose structure and operation are identical to those of the sealing assemblies 5 and 6 described previously.

The nickelling rod 71 shown in FIG. 4 is also provided with a distribution block 71*b* identical to the block 1*b* shown in FIG. 1. This distribution block 71*b* is fixed on a support 73 situated outside the water container 61 and carrying fastened to it the end of the flexible guide hose 67 opposite to the end where the carrier 65 and the tube inlet are situated.

The rigid part 70 of the nickelling rod is connected to the distribution block 71*b* by a body 72 consisting of coaxial flexible ducts permitting the supply of fluid and of electric current to the rigid part 70 of the nickelling rod.

The construction of a deformable body of a nickelling rod, such as the body 72, will be described with reference to FIGS. 6 and 7.

The device shown in FIG. 4 makes it possible to introduce a nickelling rod into a steam generator tube and to control the nickelling operation from outside the water container. The operations can be carried out by remote control of the carrier device 63, remote introduction of the rod in the desired position, and control from outside, at the distribution block 71*b*, of the tube coating operation.

By using a flexible body 72 of adequate length, it is possible to effect nickelling in the straight part of the tube 20 at any height above the tube plate 60.

Figure 5:
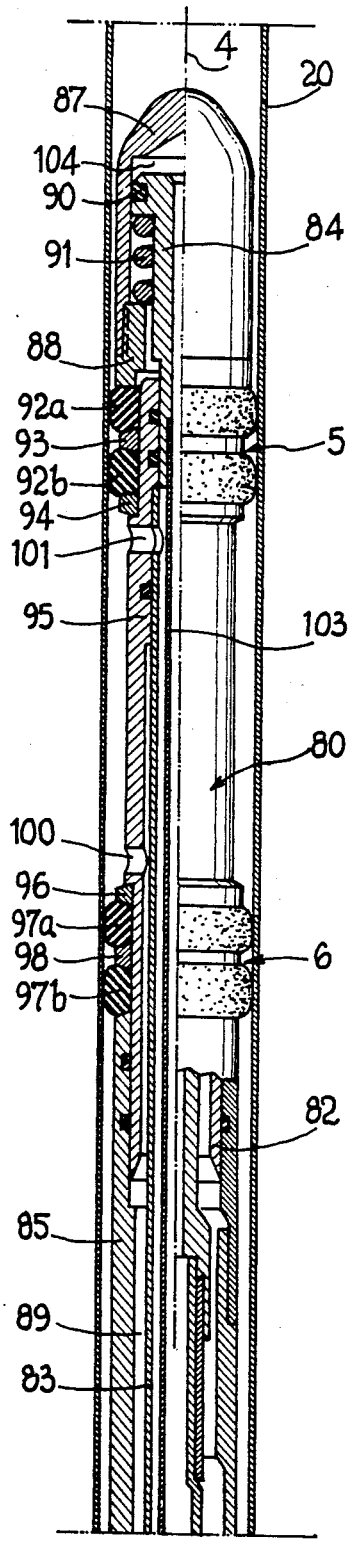
FIG. 5 is a view in elevation, partly in section, of a further embodiment of part of a nickelling rod, showing a sealing device.

FIG. 5 shows a modified form the sealing assemblies 5 and 6 of a nickelling rod 80 introduced into a tube 20, in operating position.

The nickelling rod comprises a body 82 of tubular shape, consisting of a simple tube 82 fastened at the top to a top end member 84 and connected at the bottom to a sleeve 85 coaxial to the tube 83 and situated outside the latter, with which it forms an annular duct 89 allowing the passage of the electrolyte liquid. The tube 83 and the sleeve 85 have the common axis 4, which is identical with the axis of the tube, when the nickelling rod 80 is in operating position in the tube 20.

It should be noted that the tube 83 and the sleeve 85 may be replaced over part of their length, starting from a point situated beneath the sealing assembly 86, by flexible hoses connected at one end to the rigid part of the body 82 of the rod 80 and at their other end to a fluid distribution block (not shown).

The embodiment utilizing a flexible hose makes it possible to introduce and control the nickelling rod from outside the water container of a steam generator.

On the top member 84 of the body 82 of the rod is mounted a profiled head 87 fastened to a piston 88. Leaktightness between the head 87 and the member 84 is ensured by a seal 90.

A coil spring 91 is interposed between the member 84 forming part of the tubular body 82 of the rod and the piston 88. The spring 91 applies the piston 88 against a first annular elastic seal 92*a*, which in turn transmits the pressure of the piston 88 to a second annular seal 92*b*, with the aid of a support spacer 93. The second annular seal 92*b* bears against a radial flange 94 of a sleeve 95 constituting the electrode of the nickelling rod 80.

The sleeve 95 is mounted for free sliding movement around the tube 83 of the body 82 of the nickelling rod. The bottom of the sleeve 95 comes to bear by way of a radial flange 96 against a first annular seal 97*a*, which in turn bears by way of a spacer 98 against a second annular seal 97*b* bearing against the end of the sleeve 85 fastened to the tube 83 of the rod body 82.

The pressure applied by the piston 88 to the annular seals 92*a* and 92*b* through the action of the spring 91 is transmitted to the sleeve 95, which thus applies pressure to the seals 97*a* and 97*b*.

All the annular seals 92*a*, 92*b*, 97*a* and 97*b* are thus compressed simultaneously through the action of the spring 91, so that the radial deformation of these annular seals, which come into contact with the inside surface of the tube 20, ensures the leaktightness of the treatment zone situated between the sealing assemblies 5 and 6 and at the site of the electrode 95.

The electrolyte liquid is introduced into the tube, outside the body 82 of the rod, through the annular duct 89 communicating at its top end with openings 100 passing through the electrode 95. The electrolyte liquid circulates between the electrode 95 and the inside surface of the tube 20 before penetrating into the openings 101 passing through the electrode 95 and the tube 83 of the body 82 of the nickelling rod. The electrolyte liquid then returns through the interior of the tube 83 to the distribution block connected to the end (not shown) of the nickelling rod 80.

The nickelling rod 80 also incorporates, along its axis 4, a compressed air supply duct 103 connected to the inside bore of the end member 84 of the body 82, leading into a chamber 104 formed between the head 87 and the end of the member 84. The chamber 104 is made leaktight by means of the seal 90. When compressed air is passed into the tube 103 and into the chamber 104, the head 87 and the piston 88 are moved upwards, compress the spring 91, and release the pressure applied to the annular seals 92*a* and 92*b*. The support pressure no longer being transmitted to the electrode 95 by the annular seal 92*b*, said electrode relaxes its pressure on the bottom seals 97*a* and 97*b*.

The nickelling rod 80 can then be displaced inside the tube 20, for example for the purpose of extraction from the tube, the seals remaining in the unexpanded position as long as the compressed air pressure is maintained in the chamber 104.

The device illustrated in FIG. 5 is called a positive security device because the action of the spring 91 enables leaktightness between the seals and the inside surface of the tube to be achieved automatically, and because it is necessary to apply pressure to decompress the seals and remove them from contact with the inside wall of the tube 20.

Figure 7:
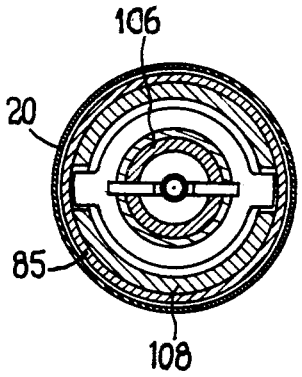
FIG. 7 is a view in cross-section on the line 7—7 in FIG. 6.
Figure 6:
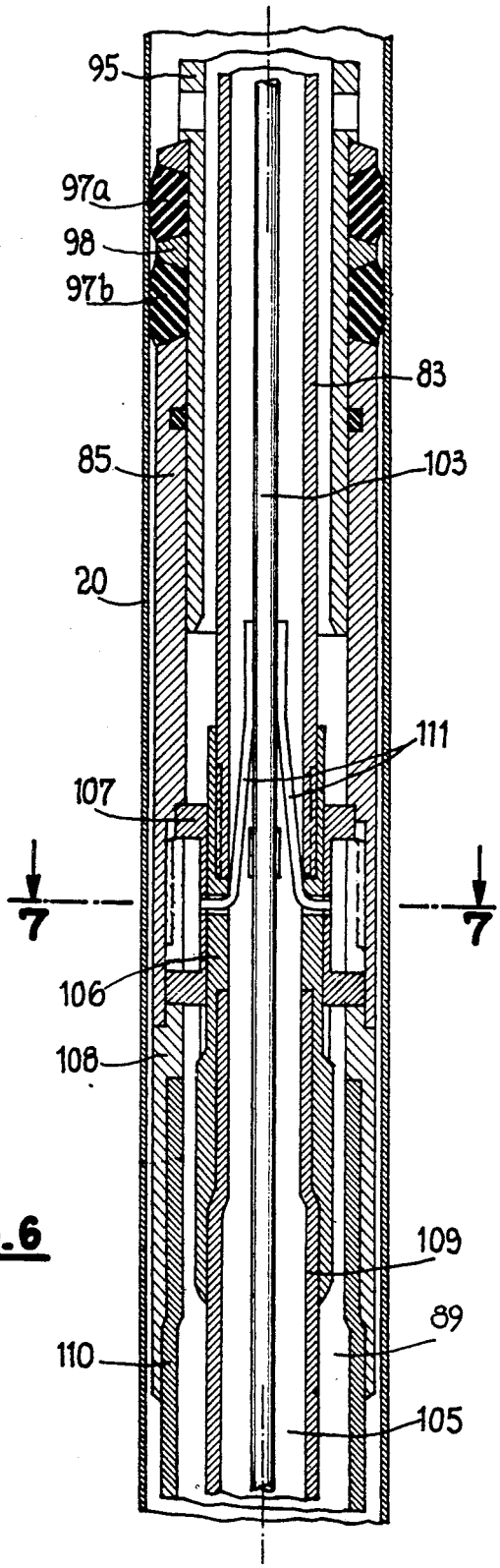
FIG. 6 is a view in axial section of a part of a nickelling rod having a flexible portion, as shown in FIG. 5.

FIGS. 6 and 7 show a construction of the bottom part of a nickelling rod of the type shown in FIG. 5, i.e. of the positive security type. Corresponding components in FIG. 5 on the one hand and in FIGS. 6 and 7 on the other hand have been given the same reference numerals.

The tube 83 of the tubular body 82 of the rod is connected at the bottom to a connection 106 comprising an end piece 107 having a snug, which joins it to the sleeve 85. The sleeve 85 is in turn fastened at the bottom to a connection 108. The two connections 106 and 108 make it possible to connect the rigid part of the rod, at the sites of the tubular members 83 and 85, to coaxial flexible hoses 109 and 110, respectively. The hoses 109 and 110 constitute a flexible hose similar to the body 72 shown in FIG. 4, and at their ends opposite to the connections 106 and 108 are connected to the distribution block (not shown) of the nickelling rod.

A flexible hose 103 for the supply of compressed air for unlocking the sealing devices of the positive security rod is fixed by means of fingers 111 to the connection 106.

The electrolyte liquid is introduced into the rigid part of the rod by way of the annular duct 89 formed between the flexible hoses 109 and 110. The electrolyte is recovered in the central part of the tube 83, and then in the inside space 105 of the hose 109.

The treatment rod according to the invention has the advantages of incorporating a simple sealing device which is extremely reliable in operation.

This sealing device can very easily be remote controlled and requires no substantial modifications of the structure of the rod.

The treatment rod can be remote controlled and does not require direct intervention near the tube which is to be treated.

The invention is not restricted to the embodiments which have been described.

The seal compressing pistons may have a shape different from that described and be operated by other mechanical, hydraulic or pneumatic means than those described.

The structure of the rod may be different and may comprise successive rigid and flexible parts having lengths adapted to the shape and dimensions of the tubes to be treated.

Finally, the treatment rod according to the invention can be used not only for nickelling or for forming other metal coatings on the inside surface of a tube, but also for treatments different from coating, such as cleaning or electrolytic or chemical machining or other surface treatments making it necessary to bring the inside surface of the tube into contact with a reactive liquid.

I claim:

1. Tubular rod for electrolytic treatment of the inside surface of a tube (20) with an electrolyte liquid supplied through the rod (1, 70, 80), which incorporates a sealing device disposed around the tubular body (2, 82) of the rod and makes it possible to isolate a part of the inside surface of the tube (20), extending along its length, from adjacent zones of the tube, wherein the sealing device comprises two assemblies (5, 6) spaced apart over the length of the rod (1, 70, 80) and each consisting of a piston (26, 36, 88, 95) of annular shape mounted for movement in the axial direction around the body (2, 82) of the rod, at least one flexible annular seal **(32, 42, 92*a*, 92*b*, 97*a*, 97*b*) disposed around the body (2, 82) of the rod and interposed, in the axial direction, between one end of the piston (26, 36, 88, 95) and a radial support flange (33, 43, 94), and means (29, 25, 35, 91, 103, 104) for operating the piston for its displacement in the axial direction in order to effect the compression and radial expansion of the seal (32, 42, 92*a*, 92*b*, 97*a*, 97*b*)**.

2. Tubular rod according to claim 1, wherein the means operating the piston (26, 36) is composed of a pneumatic ram comprising a chamber (25, 35) in which the piston (26, 36) is mounted for sliding and supplied with pressurized fluid from one end of the tubular rod by way of a compressed air duct (29) disposed along the length of the body (2) of the rod.

3. Tubular rod according to claim 1, wherein the means operating the piston (88) of at least one of the sealing assemblies (5, 6) consists of a coil spring (91) interposed between a part of the body (82) of the rod (80) and one end of the piston (88).

4. Tubular rod according to claim 3, wherein the piston (88) is fastened to a hollow member (87) closed at one end and mounted for sliding in the axial direction on one end of the body (82) of the rod engaged in the tube (20) during operation, the member (87) delimiting together with the body (82) of the rod a chamber (104) connected to a pipe (103) supplying pressurized fluid for the displacement of the hollow member (87) and the piston (88) in the opposite direction to the action applied by the spring (91).

5. Tubular rod according to claim 3, wherein the piston (92) of one of the sealing assemblies (6), or second assembly, is composed of a sleeve (95) mounted for sliding in the axial direction on the body (82) of the rod and interposed between the seal of the other sealing assembly (5), or first assembly, which comes to bear against a radial flange of the sleeve (95), and the seal **(97*a*, 97*b*) of the second assembly bearing against a radial flange of the body (82) of the rod, the pistons (87, 95) of the two sealing assemblies (5, 6) having the spring (91)** as their common operating means.

6. Tubular rod according to claim 1, comprising a tubular portion **(1*a*) constituting the actual rod, and a distributor block (1*b*) connected to one end of the portion (1*a*) and provided with ducts (10, 11, 29)** distributing fluids into the rod.

7. Tubular rod according to claim 6, wherein the distributor block **(1*b*) is connected to the portion (1*a*) of the rod by means of a flexible tubular body (72)**.

8. Tubular rod according to claim 6, wherein the distributor block **(1*b*) has at least one duct (10, 11) for distribution of the electrolyte liquid for the treatment of the tube (20), and at least one duct (29) for supplying the rod with pressurized fluid for operating the sealing assemblies (5, 6)**.

* * * * *